United States Patent [19]

Hartwig et al.

[11] Patent Number: 4,584,015

[45] Date of Patent: Apr. 22, 1986

[54] PROCESS AND SYSTEM FOR THE PRODUCTION OF VERY PURE ALLOYS

[75] Inventors: Jürgen Hartwig, Essen; Johannes Jachowski, Duisburg; Paul Pant, Essen, all of Fed. Rep. of Germany

[73] Assignee: Fried. Krupp Gesellschaft mit beschrankter Haftung, Fed. Rep. of Germany

[21] Appl. No.: 654,087

[22] Filed: Sep. 25, 1984

[30] Foreign Application Priority Data

Sep. 26, 1983 [DE] Fed. Rep. of Germany ..... 3334733

[51] Int. Cl.[4] ..... C22B 4/00; C21C 7/10

[52] U.S. Cl. ..... 75/10 V; 75/10 R; 75/49

[58] Field of Search ..... 75/49, 10 V, 10 R

[56] References Cited

U.S. PATENT DOCUMENTS

| | | | |
|---|---|---|---|
| 3,185,565 | 5/1965 | Taylor | 75/49 |
| 3,230,074 | 1/1966 | Roy | 75/49 |
| 3,306,731 | 2/1967 | Messing | 75/49 |
| 3,342,250 | 9/1967 | Treppschuh | 75/49 |
| 3,467,167 | 9/1969 | Mahin | 75/49 |
| 3,764,297 | 10/1973 | Coad | 75/49 |
| 3,798,025 | 3/1974 | Ramachandron | 75/49 |

*Primary Examiner*—Peter D. Rosenberg
*Attorney, Agent, or Firm*—Sughrue, Mion, Zinn, Macpeak, and Seas

[57] ABSTRACT

Process and system for the production of very pure alloys. The starting materials are first melted and vacuum treated in an induction crucible inside a vacuum melt system, and then are poured into a second melt crucible, and there brought to casting temperature and held there. An opening beneath the melt in the second melt crucible is used for pouring out the melt. The system for carrying out the process comprises a vacuum melt crucible assembly containing an induction melt crucible and a second melt crucible. The second melt crucible has an orifice in its lower area which is operated by a sealing arrangement. A chamber is arranged underneath the second melt crucible.

14 Claims, 1 Drawing Figure

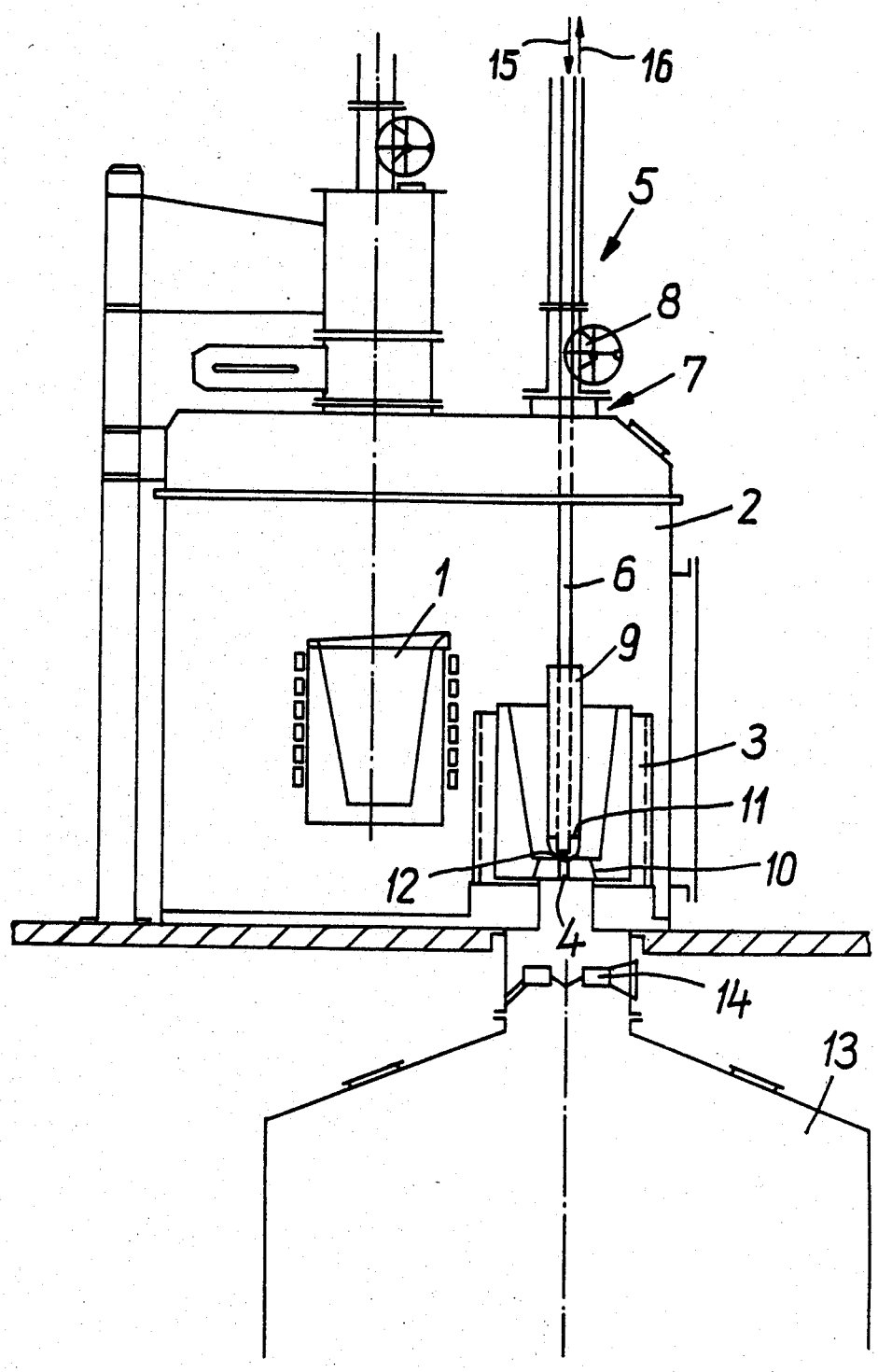
15
16
5
8
7
2
6
1
9
3
11
12
10
4
14
13

PROCESS AND SYSTEM FOR THE PRODUCTION OF VERY PURE ALLOYS

BACKGROUND OF THE INVENTION

The present invention relates to a process and apparatus for producing very pure alloys, and more particulary to an improved process and apparatus for producing very pure alloys melt-metallurgically in an vacuum melting assembly.

In an known process for producing alloys, the starting material which forms the alloy is melted in an induction crucible, is subjected to a vacuum treatment and subsequently poured into a resistance-heated casting tundish, out of which it is poured upon formation of a certain metallostatic level and reaches an atomizing chamber through, for example, a atomizing system. In this process, especially in the initial phase of the casting, in which the metallostatic level is not yet attained in the casting tundish, ceramic particles of the lining of the induction crucible and slag particles reach the atomizing chamber. The slag particles also reach the atomizing chamber during the final phase or emptying of the casting tundish. Furthermore, in the process, the danger exists that the liquid material will react with the lining of the casting tundish accompanied by formation of further impurities which also reach the final product.

It is also known to melt the starting material which forms the alloy in an induction crucible having an orifice arranged in the floor, wherein the floor opening can be sealed with a corresponding plug arrangement. With this process, the slag particles indeed remain largely on the surface of the melt, yet the danger exists that the sealing arrangement will be damaged not only by the filling of the crucible with the solid starting material, but also that the sealing faces of the sealing arrangement, that is, the sealing part als well as the orifice, will be eroded by the the continual turbulence of the melt produced in the induction crucible.

SUMMARY OF THE INVENTION

An object of the present invention is to provide for the production of very pure alloys, by which the degree of the alloy is improved and is maintained continuously through the entire casting phase.

Another object of the present invention is to provide a system for performing the process.

Additional objects and advantages of the present invention will be set forth in part in the description which follows and in part will be obvious from the description or can be learned by practice of the invention. The objects and advantages are achieved by means of the processes, instrumentalities and combinations particulary pointed out in the appended claims.

To achieve the foregoing objectes and in accordance with its purpose, the present invention provides a process for the production of a very pure alloy, by which a starting material is treated melt-metallurgically in a vacuum melting assembly and subsequently cast, comprising the following steps of: (a) melting the alloy in an induction crucible and vacuum treating the melt in the induction crucible, (b) pouring the resulting melt into a second melt crucible contained in the melt assembly, (c) subjecting the melt, which is in the form of a liquid bath, to a refining treatment in the second crucible during which the entire melt is brought to a casting temperature and the bath in the second melt crucible is maintained without movement until impurities have risen, (d) pouring the melt, at a constant temperature, out of an orifice which is under the surface of the bath, and (e) terminating the pouring from the second melt crucible, before the impurities which have risen to the surface of the bath can flow out with the bath.

While the movement of the melt bath desired for the vacuum treatment is present through the turbulence in the melt, produced continuously by the induction crucible, the material in the second melt crucible is maintained at rest, i.e. without induction-induced turbulence. The absence of turbulence in the melt bath is a specific property of resistance-heated furnaces. Thereby, the non-metallic impurities, by their corresponding buoyancy, can reach the surface of the bath in the second melt crucible and remain there at the surface of the bath. The melt contained in the second melt crucible, then, has a higher degree of purity compared to the conditions in the induction crucible. Because of the concentration of the nonmetallic impurities found on the surface of the melt before the discharge from the second melt crucible through the lower orifice, a very pure alloy material flows from the beginning of the discharge (opening of the lower orifice) and continues on throughout the discharge. The discharge of the nonmetallic impurities can be avoided and therefore a high degree of purity can be maintained through the entire casting phase from the second melt crucible by timely operation of the sealing arrangement which seals the orifice of the second melt crucible.

The degree of purity can be even more favorably influenced by feeding an inert gas, such as argon, helium, nitrogen etc. to the melt in the lower area of the second melt crucible to assist the refining treatment by accelerating the buoyancy-induced movement of the impurities.

The present invention also provides a system for producing a very pure alloy, by which a starting material is treated melt metallurgically in a vacuum melting assembly and subsequently cast, comprising: an induction melt crucible contained in a vacuum melt assembly, a second, stationary melt crucible mounted in the vacuum melt assembly into which is poured the liquid alloy from the induction melt crucible, a discharge orifice disposed in the bottom of the second melt crucible, a sealing arrangement to seal the orifice, and a chamber beneath the second melt crucible for solidifying liquid alloy which is discharged from the second melt crucible.

Preferably, the second melt crucible is formed as a resistance-heated melt furnace. In another preferred embodiment of the present invention, the second melt crucible is heated inductively via a susceptor, which is a tube of graphite, for example, placed between the induction coil and the crucible and which absorbs the magnetizing currents and transfers the heat via radiation and convection to the melt, so that in the melt is no turbulence. In still another preferred embodiment of the present invention, the second melt crucible is operated by high frequency, which creates only slight turbulence in the extern regions of the melt.

It is also preferred to provide nozzles in the lower area of the second melt crucible for the supply of inert gas.

Preferably, the sealing arrangement comprises a metallic stopper rod with a temperature-resistant coat. The lower part of the stopper rod preferably is provided with at least one opening to conduct inert gas. Preferably there are at least two openings arranged laterally in the lower part of the stopper rod directed into the cavity of the crucible of the second melt assembly provided for the reception of the alloy. In one prefered embodiment of the present invention, the stopper rod has an outlet opening directed towards the orifice in the bottom of the second melt crucible. Preferably, the sealing arrangement is cooled by a coolant.

It is understood that both the foregoing general description and the following detailed description are exemplary and explanatory, but are not restrictive of the invention.

BRIEF DESCRIPTION OF THE DRAWING

The sole FIGURE of the drawing is a schematic illustration of an apparatus in accordance with the present invention for achieving the process of the present invention.

DETAILED DESCRIPTION OF THE INVENTION

Referring now to the drawing, there is shown, as an example of the subject matter of the present invention, a system for inert gas atomizing of alloy powder. The system contains an induction melting crucible 1, which is contained in a vacuum vessel 2. In addition, a second melt crucible in the form of a resistance-heated melt furnace 3, which has in its floor an orifice in the form of a discharge nozzle 4, is contained in vacuum vessel 2. A sealing arrangement, generally 5, is disposed in melt furnace 3, and comprises a stopper rod 6, which is introduced from above through a vacuum-tight guide 7 into vacuum vessel 2 and can be operated through a regulating apparatus 8, which regulates the up and down movement of the stopper rod. On its lower end, that is, its end which is within melt furnace 3, stopper rod 6 is equipped with a jacket and/or coating 9, consisting of zirconia, high alumina or other temperature-resistant materials.

The portion of the stopper rod 6 above the lining (that is, found above jacket oder coating 9), the vacuum-tight guide 7 and/or the regulating apparatus 8 can be connected via an inlet 15 and an outlet 16 to a cooling system (not depicted) in order to hold harmful thermal influences to a minimum.

In the lower area of melt furnace 3, that is, in the floor or bottom wall of melt furnace 3, nozzles 10 are arranged, which point inside melt furnace 3 into the cavity of the crucible and on the outside are connected to an inert gas pipeline (not depicted).

Stopper rod 6 has openings in the form of nozzles 11 on its lower end, which nozzles are directed to the crucible cavity of melt furnace 3, as well as one opening in the form of a nozzle 12 arranged in the direction of discharge nozzle 4 in order to assist the atomizing process. The nozzles 11 and 12 are hooked up to an inert gas supply (not depicted).

Below orifice nozzle 4 is an atomizing chamber 13, which has on its upper end an atomizing arrangement 14 situated exactly below orifice nozzle 4.

For melting and for vacuum treatment, the starting material is first fed into induction melt crucible 1 where it is melted and subjected to vacuum treatment. After the vacuum treatment, the resulting liquid alloy is poured from melt crucible 1 into the resistance-heated melt furnace 3 to attain the required casting temperature and for the refining treatment, that is, to remove all nonmetallic impurities by the buoyancy depending on their density. The buoyant movement depending on density of the nonmetallic impurities, can be assisted by the inert gas streaming from the nozzles 10 and/or 11 through the melt. In the resistance-heated melt furnace 3, the melt is held at a constant casting temperature for the duration of the refining treatment.

For the pouring of the liquid alloy into atomizing chamber 13, stopper rod 6 is raised through operations of the regulating apparatus 8, and thereby orifice nozzle 4 is opened. In addition, the inert gas stream flowing out through nozzle 12 can be used to assist the atomizing of the alloy stream flowing into spray chamber 13.

Instead of atomizing, the very pure material produced by the described process may be poured into investment or continious casting equipment or into ingot molds.

Materials processed according to the invention are Ni-or Co-based superalloys for high temperature a medical applications, corrosion resistant alloys based on Cr-Ni-Mo-Fe (for example AISI 304, AISI 316) or other special materials.

EXAMPLE OF A TECHNOLOGY FOR THE PRODUCTION OF VERY PURE ALLOYS

In order to produce Ni- or Co-based superalloy powders or castings in superclean qualities the following technological steps are to be carried out:

The crucible of the induction furnace, consisting of high alumina or zirconia, is charged with scrap of identical grade and raw materials such as chromium, nickel, cobalt, molybdenum.

The vacuum melting assembly is closed and evacuated.

The pressure in the assembly is raised by means of argon or helium to 200 mbar.

Electric power is switched on and the charge is melted down.

After all substances of the charge are in liquid state, the melt bath is evacuated until oxygen content reaches a value below 0.010%.

After the end of the evacuation process the pressure in the assembly is raised by means of argon or helium to 100 mbar.

Alloying materials such as aluminium and titanium are added to the melt and the chemical composition of the melt is corrected according to the results of chemical analysis of samples taken from the melt-bath.

The temperature of the melt-bath is raised to the required casting temperature (1550° C.–1600° C.).

The melt is poured from the induction furnace into a high alumina or zirconia crucible of the resistance-heated furnace, which has meanwhile been heated to a temperature of ~1500° C.

The temperature of the melt-bath in the resistance-heated furnace is then raised to the required casting temperature (1550° C.–1600° C.). At this temperature the melt-bath is held for 30 to 40 minutes. Because there is no induction induced turbulence in the melt, nonmetallic inclusions can due to buoyancy float undisturbed to the surface of the bath. In order to accelerate the upward movement of the impurities a slight argon stream can be introduced into the bath from the nozzles in the bottom of the crucible or in the bottom part of the stopper rod.

At the end of the holding time the high alumina or zirconia coated stopper rod, sealing the discharge orifice in the bottom of the crucible is lifted upwards and the liquid alloy streams into the atomizing chamber or into investment or continuous casting equipment or into ingot molds.

As the liquid alloy is being poured through the discharge orifice, the pressure in the vacuum assembly is raised continuously in order to balance the continuous drop in the metallostatic pressure caused by the falling level of the liquid bath.

In order to prevent the indusions on the surface of the melt-bath from passing through the orifice the stopper rod closed the orifice before the surface of the melt-bath reaches the level of the discharge orifice.

It will be understood that the above description of the present invention is applicable to various modifications, changes and adaptations, and the same are intended to be comprehended within the meaning and the range of equivalents of the appended claims.

What is claimed is:

1. Process for the production of an alloy, by which a starting material is treated in a vacuummelting assembly and subsequently cast comprising the steps of:

(a) melting the alloy in an induction crucible and vacuum treating the melt in the induction crucible during induction heating, (b) pouring the resulting melt into a second melt crucible contained in the melt assembly, (c) subjecting the melt, which is in the form of a liquid bath, to a refining treatment in the second melt crucible, during which the entire melt is brought to a casting temperature and the bath in the second melt crucible is maintained without movement until impurities have risen, (d) pouring the melt, at a constant temperature, out of an orifice which is under the surface of the bath, and (e) terminating the pouring from the second melt crucible, before the impurities which have risen to the surface of the bath can flow out with the bath.

2. Process according to claim 1, wherein inert gas is fed to the melt in the lower area of the second melt crucible in order to assist the refining treatment.

3. System for producing an alloy, by which a starting material is treated in a vacuum melting assembly and subsequently cast, comprising:

(a) an induction melt crucible contained in a vacuum melt assembly, (b) a second, stationary melt crucible mounted in the melt assembly and having a cavity for receiving alloy from the induction melt crucible, (c) a discharge orifice disposed in the lower area of the second melt crucible, (d) sealing arrangement to seal the orifice, and (e) a chamber beneath the second melt crucible for solidifying liquid alloy which is discharged from the second melt crucible.

4. System according to claim 3, wherein the second melt crucible is formed as a resistance-heated melt furnace.

5. System according to claim 3, wherein the second melt crucible is heated inductively via a susceptor.

6. System according to claim 3, wherein the second melt crucible is operated by high frequency.

7. System according to claim 3, wherein nozzles are provided in the lower area of the second melt crucible for the supply of inert gas.

8. System according to claim 3, wherein the sealing arrangement comprises a metallic stopper rod having a temperature resistant coat.

9. System according to claim 8, wherein the lower part of the stopper rod is provided with at least one opening to conduct inert gas.

10. System according to claim 9, wherein the at least one opening in the lower part of the stopper rod comprises at least two laterally arranged openings pointing into the cavity of the second melt crucible.

11. System according to claim 10, wherein the at least one opening in the lower part of the stopper rod further comprises an outlet opening pointing into the discharge orifice of the second melt crucible.

12. System according to claim 9, wherein the at least one opening in the lower part of the stopper rod comprises an outlet opening pointing into the discharge orifice of the second melt crucible.

13. System according to claim 8, wherein the sealing arrangement is cooled by a coolant.

14. System for producing an alloy, by which a starting material is treated in a vacuum melting assembly and subsequently cast, comprising:

(a) an induction melt crucible contained in a vacuum melt assembly, (b) a second, stationary melt crucible mounted in the melt assembly and having a cavity for receiving alloy from the induction melt crucible, (c) a discharge orifice disposed in the lower area of the second melt crucible, and (d) sealing arrangement to seal the orifice.

* * * * *